US006422320B1

(12) United States Patent
Mather et al.

(10) Patent No.: US 6,422,320 B1
(45) Date of Patent: Jul. 23, 2002

(54) ENHANCED AGENT MISTING EXTINGUISHER DESIGN FOR FIRE FIGHTING

(75) Inventors: Joseph Douglas Mather; Joe Lifke; Ted Moore, all of Albuquerque, NM (US)

(73) Assignee: University of New Mexico, Albuquerque, NM (US)

( * ) Notice: Subject to any disclaimer, the term of this patent is extended or adjusted under 35 U.S.C. 154(b) by 0 days.

(21) Appl. No.: 09/678,509

(22) Filed: Oct. 2, 2000

Related U.S. Application Data

(60) Provisional application No. 60/157,351, filed on Sep. 30, 1999.

(51) Int. Cl.[7] ..... A62C 35/58
(52) U.S. Cl. ..... 169/88; 169/30
(58) Field of Search ..... 169/30, 76, 85, 169/88; 239/337; 222/401.18

(56) References Cited

U.S. PATENT DOCUMENTS

| | | | | | |
|---|---|---|---|---|---|
| 2,385,449 | A | * | 9/1945 | Koehler | 169/30 |
| 3,260,421 | A | * | 7/1966 | Rabussier | 239/337 |
| 6,138,766 | A | * | 10/2000 | Finnerty et al. | 169/85 |
| 6,189,624 | B1 | * | 2/2001 | James | 169/61 |
| 6,189,625 | B1 | * | 2/2001 | Hopkins | 169/88 |
| 6,223,827 | B1 | * | 5/2001 | Zuev et al. | 169/9 |

* cited by examiner

*Primary Examiner*—Lisa A. Douglas
(74) *Attorney, Agent, or Firm*—R W Becker & Associates; R W Becker

(57) ABSTRACT

A system and method for misting a liquid agent to be used for fire suppression and inertion or explosion suppression and inertion are provided. The system includes a container of pressurized liquid agent, a way to convey a stream of the agent to a discharge nozzle, and a way to introduce pressurized gas to the stream of agent.

18 Claims, 2 Drawing Sheets

ENHANCED AGENT MISTING EXTINGUISHER DESIGN FOR FIRE FIGHTING

This application claims priority from provisional application Ser. No. 60/157,351, filed Sep. 30. 1999.

BACKGROUND OF THE INVENTION

The present invention relates to a system and method for misting a liquid agent that is to be used for suppression and inertion, or explosion suppression and inertion.

Current portable, hand-held and fixed extinguishers rely on internal pressure to force the discharge of fire suppression or inertion agents through a nozzle to produce a spray pattern to attempt to suppress or extinguish fires (see, for example, U.S. Pat. No. 5,806,601, which discloses a means for pressurizing a fire-fighting liquid in a container, and injects gas having a pressure of at least 100 bar into a discharge line to drive out the liquid).

Tests have shown that for a water/potassium acetate agent in current commercial extinguishers the spray produced completely fails to perform as a fire extinguishant for Class B fires. However, a functional and effective potassium acetate based fire extinguisher would have several very important advantages over existing Halon 1301 and 1211, hydrofluorocarbons (HFC's), and hydrofluoropoly-ether (HFPE) based extinguishers. One of the most important attributes of a potassium acetate based extinguisher is its lack of fluorine in the agent molecule, and therefore the absence of generated hydrogen fluoride (HF) upon discharge of the agent into a fire. This is of particular importance in fire suppression scenarios in a compartment where people are located, such as crewmen in a military vehicle or the like. Hydrogen fluoride can be deadly at air concentration levels of even 100 ppm. Typical hydrogen fluoride concentration levels in enclosed spaces where HFC's are employed in fire suppression tests have been shown to rapidly reach levels of 4000 ppm. Inhalation of air containing hydrogen fluoride at such levels would be almost instantaneously lethal.

It is therefore an object of the present invention to provide a means of effectively delivering, i.e. misting, a non-hydrogen fluoride generating extinguishing agent, and to enhance the fire suppressing performance of such an agent, such as potassium acetate. In particular, it is an object of the present invention to provide continuous misting of such an agent, either in hand-held fire extinguishers or in fixed systems.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The system of the present invention for misting a liquid agent that is intended to be used for fire suppression and inertion or explosion suppression and inertion, comprises a container of pressurized liquid agent, means for conveying a stream of such agent to a discharge nozzle, and means for introducing a pressurized gas to the stream of agent. The system is preferably operated at a pressure of from 10 to 600 psig.

Heretofore known fire extinguishing systems using, for example, potassium acetate are inadequate because the spray produced contains relatively large droplets that settle too quickly to the ground. In contrast, when using the system of the present invention to introduce pressurized gas to the stream of liquid agent prior to discharge thereof, a noticeable drop in the particle size of the discharge liquid is produced, along with significantly enhanced fire suppression performance. In particular, a fine mist is produced in combination with a coarser spray. A greater agent "throw" distance is produced due to the drafting effect of the coarser spray and in part to the propulsive effect of the rapidly expanding bubbles of gas as they exit the tip of the nozzle.

Although the foregoing discussion has been directed in particular to potassium salts dissolved in water, such as potassium acetate and potassium lactate, it is to be understood that the use of the inventive system can also enhance the performance of other liquid agents. For example, new fire suppression agents such as tropodegradeable bromofluoroalkenes, bromofluoroamines, and bromofluoroethers, which often have boiling points greater than 30° C., would be dispersed as a much finer mist. Such agents could then perform as streaming or total flood agents at much lower temperatures than are currently possible.

Further specific features of the present invention will be described in detail subsequently.

DESCRIPTION OF PREFERRED EMBODIMENTS

Figure 1:
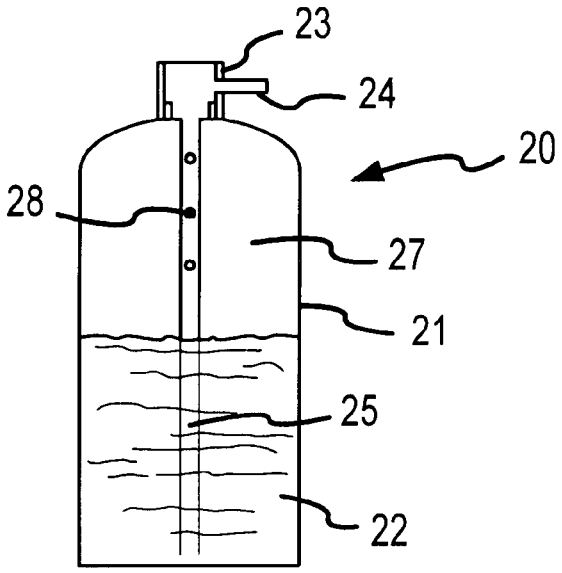
FIG. 1 illustrates a hand-held fire extinguisher employing the inventive system.

Referring now to the drawings in detail, FIG. 1 illustrates a hand-held fire extinguisher 20 that is employing the inventive system for misting a liquid agent that is intended, for example, to be used for fire suppression and inertion, or for explosion suppression and inertion.

The fire extinguisher 20 of FIG. 1 includes a container 21 that contains a liquid or liquefied agent 22. Such an agent can, for example, be a potassium salt dissolved in water, including potassium acetate and potassium lactate, water, bromofluoroalkenes, bromofluoroamines, bromofluoroethers, and HFC's. Examples of tropodegradable bromofluoro compounds are found in the following Table 1.

TABLE 1

| |
|---|
| BROMOFLUORO ALKENES |
| Bromo-2-trifluoromethyl-3,3,3,-trifluoropropene $(CF_3)_2C{=}CHBr$ |
| Bromo-2-trifluoromethyl-1,3,3,3,-tetrafluoropropene $(CF_3)_2C{=}CFBr$ |
| Bromo-3,3,3-trifluoropropene $CF_3CBr{=}CH_2$ |
| BROMOFLUORO ETHERS |
| Bromo-2-trifluoromethoxy-1,1-difluoroethane $CF_3{-}O{-}CH_2CF_2Br$ |
| Bromo-2-trifluoromethoxy-1,1,2,2-tetrafluoroethane $CF_2H{-}O{-}CFHCF_2Br$ |
| Bromo-2-fluoromethoxy-1,1,2,2-tetrafluoroethane $CH_2F{-}O{-}CF_2CF_2Br$ |
| BROMOFLUORO AMINES |
| Bis(trifluoromethyl)-2-bromo-1,2,2-trifluoroethyl amine $N(CF_3)_2(CFHCF_2Br)$ |
| Bis(trifluoromethyl)-2-bromo-1,2-difluoroethyl amine $N(CF_3)_2(CFHCFHBr)$ |

The container 21 is also provided with a valve assembly 23 and a nozzle 24 or conduit leading to such a nozzle. The nozzle 24 or appropriate conduit are in fluid communication with the valve assembly 23. A dip-tube 25 extends into the liquid agent 22 and provides fluid communication between such agent and the valve assembly 23.

Due to the fact that the container 21 is pressurized, for example via a gas such as nitrogen or some other inert and/or nonflammable gas, including carbon dioxide, argon and other noble gases, which gas is contained in the ullage 27, in other words the space above the level of the liquid agent 22 when the valve assembly 23 is opened, agent will be drawn up through the dip-tube 25. To enable proper misting of the liquid agent so that it can be an effective agent as discussed previously, one or more bleed holes 28 are, in this embodiment, provided in the dip-tube 25. Such bleed holes 28 can have a diameter from 0.01 to 0.10 inches, and in one preferred embodiment have a diameter of 0.035 inches. Pressurized gas from the ullage 27 can enter the stream of liquid agent flowing in the dip-tube 25 to the nozzle 24 as small streams of gas that enter via the bleed holes 28. The liquid and gas thus flowing up the dip-tube 25 pass through the valve assembly 23 to the nozzle 24, allowing an enhanced mist of liquid agent to be discharged, for example, for streaming-type or total flood fire suppression applications.

Figure 2:
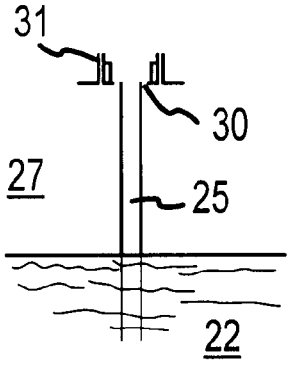
FIG. 2 is an enlarged view of a portion of the fire extinguisher of FIG. 1.

Although FIG. 1 shows the bleed holes 28 only in the dip-tube 25, it would be possible as an alternative, or in addition, to the bleed holes 28 in the dip-tube 25, to provide bleed holes at other locations. Therefore, reference is now made to FIG. 2, which illustrates the interior of the container 21 and a portion of the valve assembly 23. In particular, FIG. 2 shows additional locations 30 where bleed holes could be provided that are in direct communication with the pressurized gas in the ullage 27 of the container 21. It would also be possible to provide bleed holes at other locations of the valve assembly, or even in the nozzle, with appropriate supply lines from a container or an independent pressurized gas source then leading to such additional bleed holes. The important thing to remember is that in all cases the bleed holes allow pressurized gas to enter the flow of liquid agent prior to discharge thereof from the nozzle 24.

Figure 3:
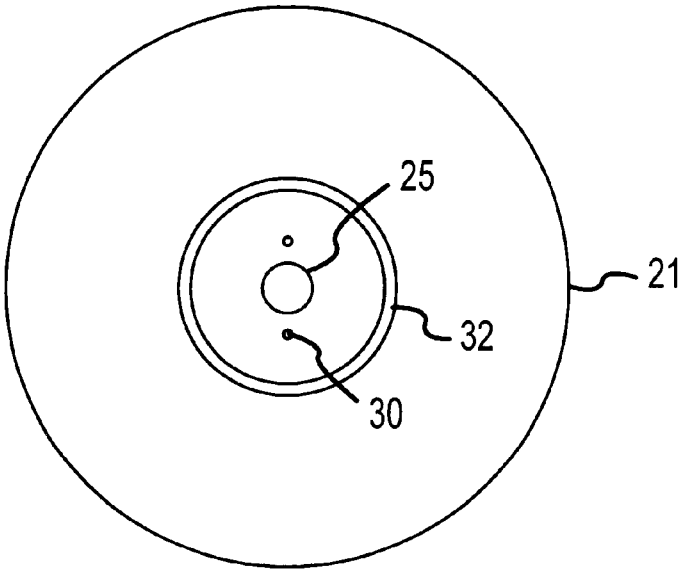
FIG. 3 is a top view of a modified embodiment of FIG. 1.

FIG. 3 is a top view onto a container 21 prior to attaching the valve assembly 23 to the threaded attachment portion 31 on the container 21. FIG. 3 illustrates the additional or alternative bleed hole locations 30.

Figure 4:
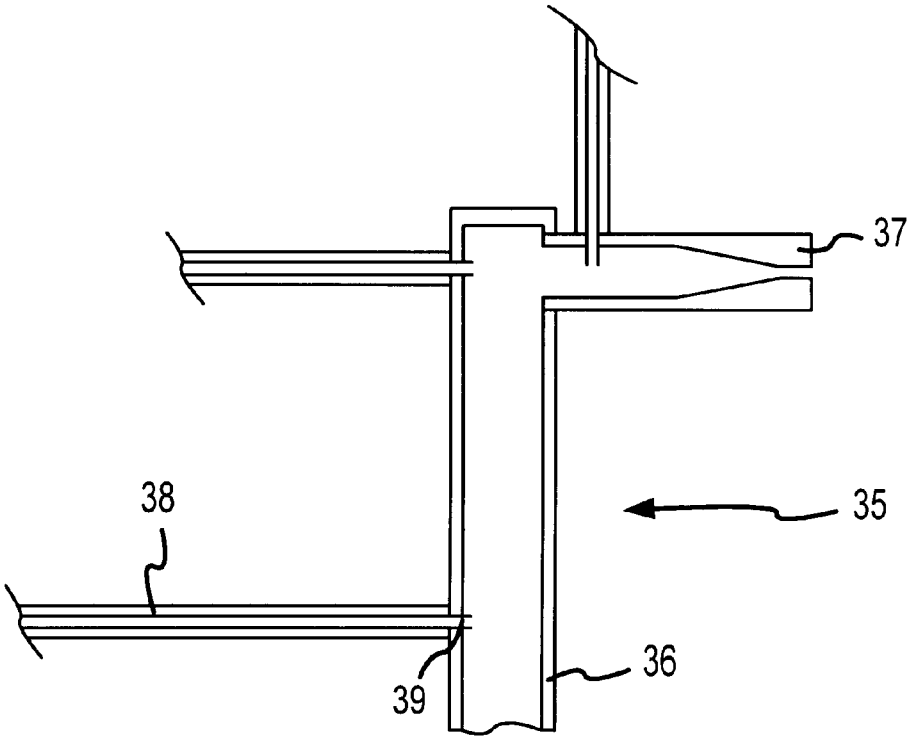
FIG. 4 shows a portion of a fixed fire extinguishing system employing the inventive system.

Pursuant to another specific embodiment of the present invention, a fixed inertion or suppression system can be provided; such a system is partially illustrated in FIG. 4, and is designated by the reference symbol 35. In the system, a conduit 36, in which a valve assembly is preferably provided, leads from a liquid agent tank or container to a nozzle 37 via which the liquid agent is discharged. In order to provide misting of the liquid agent, lines 38 lead from a source of pressurized gas, either an independent source or again from gas that is provided in the ullage of the tank or container of liquid agent to pressurize the same, to the conduit 36. Again, bleed holes 39 provide communication between the lines 38 and the conduit 36 in order to feed pressurized gas into the stream of liquid agent that is being conveyed by the conduit 36 to the nozzle 37.

The gas pressure employed in the various systems illustrated is preferably in the range of 10 to 600 psig.

Tests were conducted first without bleed holes for supplying pressurized gas to the stream of a liquid agent, such as potassium acetate or potassium lactate. The liquid agent was unable to extinguish a fire. However, in distinct contrast to the situation where no bleed holes were provided, when bleed holes were provided and pressurized gas was in fact supplied to the stream of liquid agent prior to discharge thereof, fire extinguishment was nearly instantaneous.

The present invention is, of course, in no way restricted to the specific disclosure of the specification and drawings, but also encompasses any modifications within the scope of the appended claims.

We claim:

1. A method of misting a liquid agent to be used in fire suppression and inertion as well as explosion suppression and inertion, said method including the steps of:

providing a source of pressurized liquid agent;

conveying a stream of said agent to a discharge nozzle; and introducing pressurized gas to said stream of said agent.

2. A method according to claim 1, wherein said agent is selected from the group consisting of potassium salts dissolved in water, bromofluoroalkenes, bromofluoroamines, bromofluoroethers, and HFC's.

3. A method according to claim 2, which includes the step of introducing said pressurized gas at a pressure of 10 to 600 psig.

4. A method according to claim 1, wherein said step of introducing pressurized gas to said stream of agent comprises introducing pressurized gas to said stream prior to discharge of said agent from said discharge nozzle.

5. A system for misting a liquid agent to be used for fire suppression and inertion as well as explosion suppression and inertion, said system comprising:

a container of pressurized liquid agent;

means for conveying a stream of said agent to a discharge nozzle; and means for introducing pressurized gas to said stream of said agent.

6. A system according to claim 5, wherein said liquid agent is selected from the group consisting of potassium salts dissolved in water, bromofluoroalkenes, bromofluoroamines, bromofluoroethers, and HFC's.

7. A system according to claim 6, wherein said potassium salt is potassium acetate or potassium lactate.

8. A system according to claim 5, wherein said pressurized gas is selected from the group consisting of nitrogen, carbon dioxide, argon and other noble gases.

9. A system according to claim 5, which system is at a pressure of 10 to 600 psig.

10. A system according to claim 5, which includes means for supplying pressurized gas to said container.

11. A system according to claim 1, wherein said means for introducing pressurized gas comprises a conduit for supplying pressurized gas from a supply thereof to said stream of said agent.

12. A system according to claim 11, wherein said conduit is provided with a discharge outlet having a diameter of 0.01 to 0.10 inches for discharging pressurized gas to said stream.

13. A system according to claim 5, wherein said container has a dip-tube leading from said liquid agent to said means for conveying a stream.

14. A system according to claim 13, wherein said means for introducing pressurized gas comprises bleed holes disposed in said dip-tube.

15. A system according to claim 14, wherein said holes have a diameter in the range of 0.01 and 0.10 inches.

16. A system according to claim 14, wherein said liquid agent is selected from the group consisting of potassium salts dissolved in water, bromofluoroalkenes, bromofluoroamines, bromofluoroethers, and HFC's.

17. A system according to claim 13, wherein said means for introducing pressurized gas comprises bleed holes in a wall of said container adjacent to said dip-tube.

18. A system according to claim 5, wherein said means for introducing pressurized gas to said stream of said agent comprises means for introducing pressurized gas prior to discharge of said agent from said discharge nozzle.

* * * * *